US007976336B2

(12) United States Patent
Yang et al.

(10) Patent No.: US 7,976,336 B2
(45) Date of Patent: Jul. 12, 2011

(54) TRIGGER SIGNAL-LIGHTED CONNECTOR

(75) Inventors: Jui-Ming Yang, Keelung (TW); Yen-Tung Chen, Keelung (TW)

(73) Assignee: Elka International Ltd., Taipei Hsien (TW)

( * ) Notice: Subject to any disclaimer, the term of this patent is extended or adjusted under 35 U.S.C. 154(b) by 229 days.

(21) Appl. No.: 12/457,013

(22) Filed: May 29, 2009

(65) Prior Publication Data

US 2010/0055973 A1 Mar. 4, 2010

(30) Foreign Application Priority Data

Aug. 29, 2008 (TW) ..... 97215518 U

(51) Int. Cl.
*H01R 3/00* (2006.01)

(52) U.S. Cl. ..... 439/490; 439/910

(58) Field of Classification Search ..... 439/488, 439/489, 490, 910

See application file for complete search history.

(56) References Cited

U.S. PATENT DOCUMENTS

| | | | | |
|---|---|---|---|---|
| 7,628,619 | B2 * | 12/2009 | Chuang | 439/76.1 |
| 7,661,983 | B2 * | 2/2010 | Yang et al. | 439/490 |
| 2009/0305521 | A1 * | 12/2009 | Yang et al. | 439/56 |
| 2010/0055973 | A1 * | 3/2010 | Yang et al. | 439/490 |

* cited by examiner

*Primary Examiner* — James Harvey
(74) *Attorney, Agent, or Firm* — Rosenberg, Klein & Lee

(57) ABSTRACT

A trigger signal-lighted connector including a terminal housing in which multiple terminals are inlaid; an adapter circuit board having multiple lines of printed circuits, each printed circuit being connected between one of the terminals and one of multiple signal wires, one of the printed circuits being connected to a grounding terminal, while another of the printed circuits being connected to a trigger signal terminal; and an insulation layer wrapping the terminal housing, the adapter circuit board and the signal wires. The insulation layer is made of transparent material and at least one light-emitting component is disposed on the adapter circuit board. One of two electrode pins of the light-emitting component is connected to the printed circuit, which is connected to the grounding terminal, while the other of the electrode pins is connected to the printed circuit, which is connected to the trigger signal terminal.

5 Claims, 6 Drawing Sheets

TRIGGER SIGNAL-LIGHTED CONNECTOR

BACKGROUND OF THE INVENTION

1. Field of the Invention

The present invention is related to a trigger signal-lighted connector in which a light-emitting component is soldered on the adapter circuit board between the terminals and the signal wires. When an electronic device connected to the connector is selectively turned on, the trigger signal will trigger and light up the light-emitting component to emit light outward from the connector.

2. Description of the Prior Art

A conventional connector applied to the signal cable of a multimedia device, such as a high-definition multimedia interface (HDIM) connector, generally includes a plastic housing in which multiple terminals are inlaid. Each terminal has a rear end soldered with a corresponding signal wire. The plastic housing and the signal wires are wrapped with an insulation layer.

In use of such a connector, a user cannot know the using state of the connector. That is, the user can hardly judge whether the connector is being used or not used from the appearance. Therefore, some manufacturers have developed an improved connector to which a light-emitting component is added. Two electrode pins of the light-emitting component are soldered on a set of power wires and enclosed with a transparent insulation layer. After the connector is inserted into an electronic device, the light-emitting component is lighted up to emit light outward from the connector.

A display can be connected to an AV player, a set-top box, a game machine, a digital camera, etc. via multiple signal transmission wires of the connector respectively. When turned on, the light-emitting component in the connector will light up. That is, all the light-emitting components of the connectors of all signal transmission wires will be lighted up. This causes waste of energy. More importantly, in this case, a user can hardly know which electronic device is currently used from the signal transmission wires.

SUMMARY OF THE INVENTION

It is therefore a primary object of the present invention to provide a trigger signal-lighted connector including: a terminal housing in which multiple terminals are inlaid; an adapter circuit board having multiple lines of printed circuits, each printed circuit being connected between one of the terminals and one of multiple signal wires, one of the printed circuits being connected to a grounding terminal GROUND, while another of the printed circuits being connected to a trigger signal terminal Hot Plug Detect; and an insulation layer wrapping the terminal housing, the adapter circuit board and the signal wires. The connector is characterized in that the insulation layer is made of transparent material and at least one light-emitting component is disposed on the adapter circuit board. The light-emitting component has two electrode pins. One of the electrode pins is connected to the printed circuit, which is connected to the grounding terminal, while the other of the electrode pins is connected to the printed circuit, which is connected to the trigger signal terminal. When an electronic device connected to the connector is selectively turned on, trigger signal will trigger and light up the light-emitting component.

The present invention can be best understood through the following description and accompanying drawings wherein:

DETAILED DESCRIPTION OF THE PREFERRED EMBODIMENTS

Figure 1:
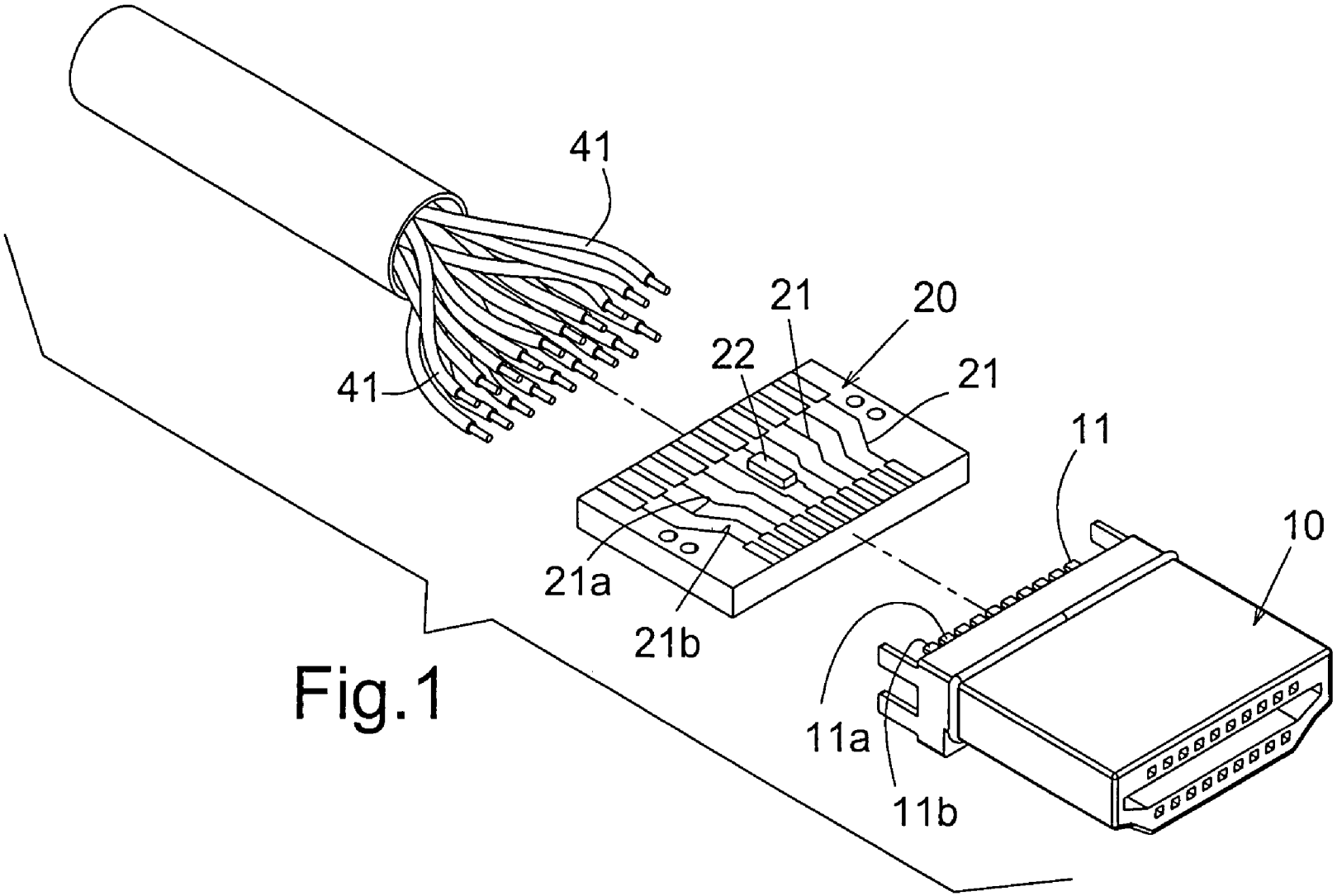
FIG. 1 is a perspective partially exploded view of the connector of the present invention.
Figure 2:
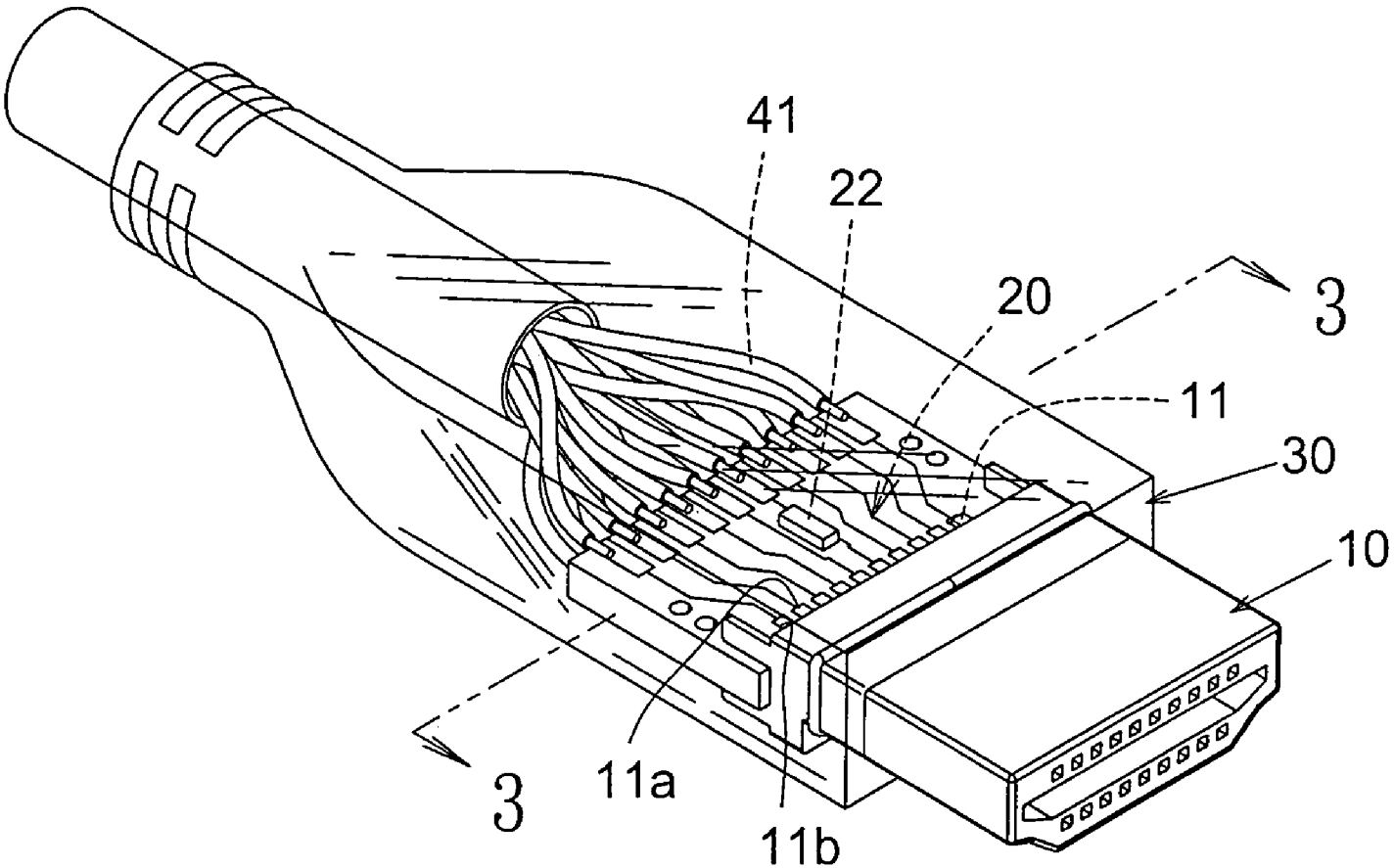
FIG. 2 is a perspective assembled view of the connector of the present invention.
Figure 3:
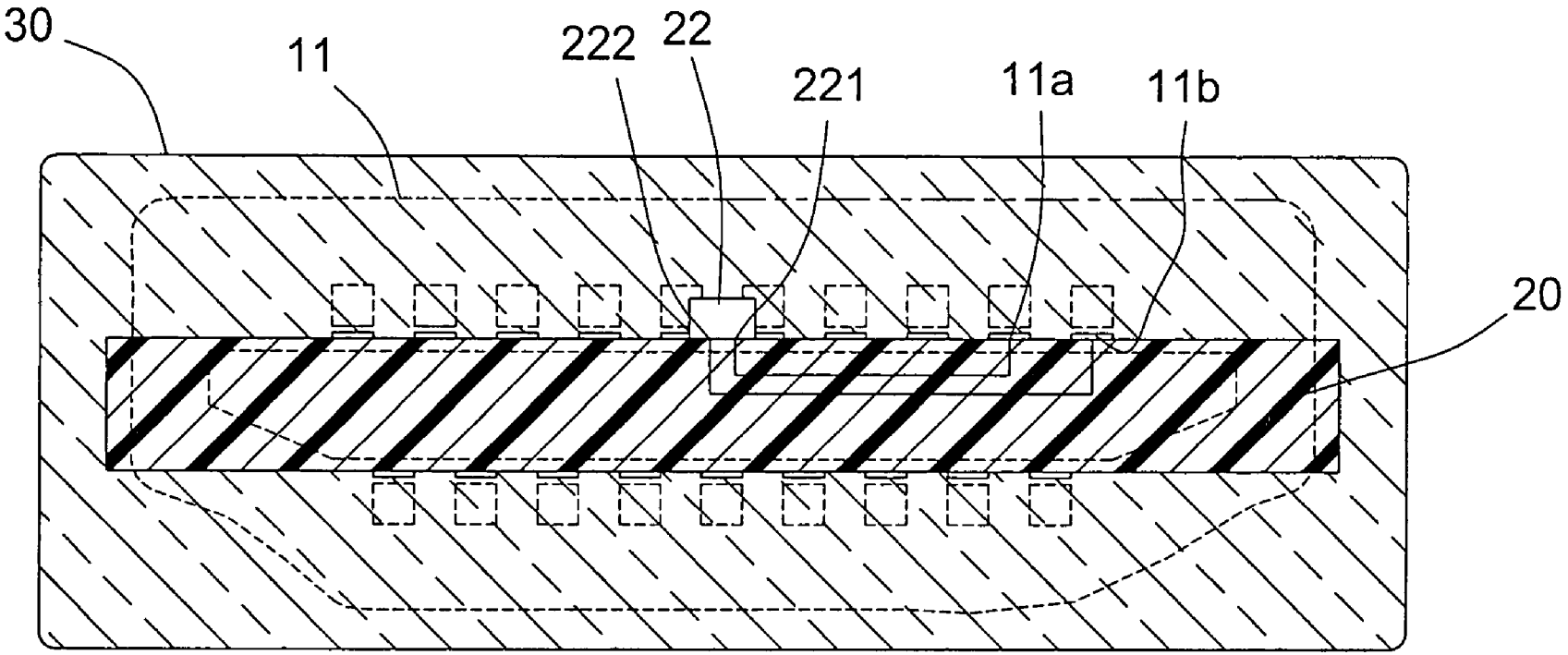
FIG. 3 is a sectional view taken along line 3-3 of FIG. 2.
Figure 4:
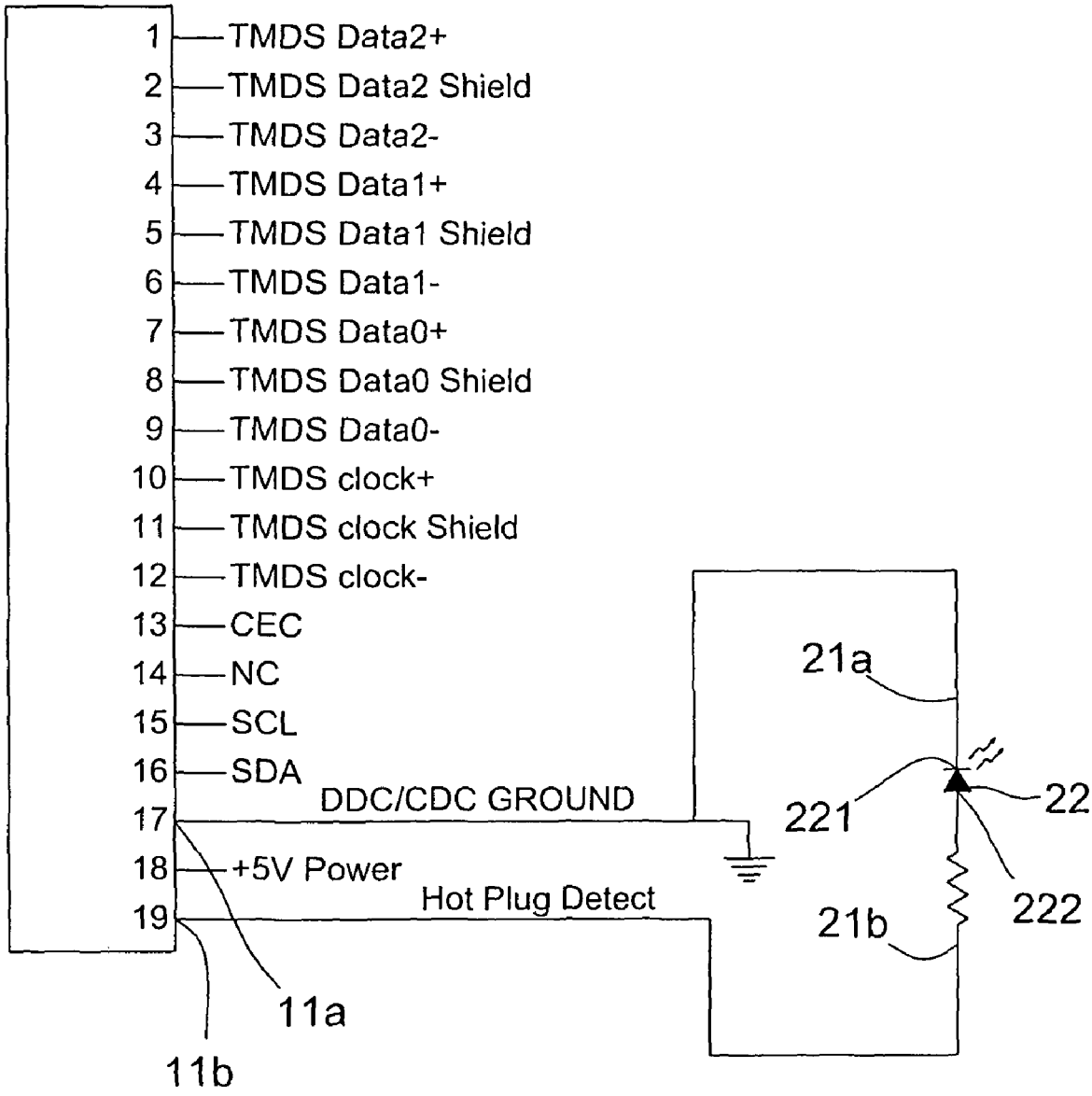
FIG. 4 is a schematic circuit diagram of a preferred embodiment of the connector of the present invention, which is an HDMI connector.

Please refer to FIGS. 1, 2, 3 and 4. The trigger signal-lighted connector of the present invention includes a terminal housing 10 in which multiple terminals 11 are inlaid and an adapter circuit board 20 having multiple lines of printed circuits 21. Each printed circuit 21 is connected between one of the terminals 11 and one of multiple signal wires 41. A printed circuit 21*a* of the printed circuits is connected to a grounding terminal 11*a*, while another printed circuit 21*b* is connected to a trigger signal terminal 11*b*. The connector of the present invention further includes an insulation layer 30 wrapping the terminal housing 10, the adapter circuit board 20 and the signal wires 41. The connector of the present invention is characterized in that the insulation layer 30 is made of transparent material and at least one light-emitting component 22 is disposed on the adapter circuit board 20. The light-emitting component 22 has two electrode pins 221, 222. The electrode pin 221 is connected to the printed circuit 21*a*, which is connected to the grounding terminal 11*a*, while the electrode pin 222 is connected to the printed circuit 21*b*, which is connected to the trigger signal terminal 11*b*. Accordingly, when an electronic device connected to the connector is selectively turned on, the trigger signal will trigger and light up the light-emitting component 22.

The trigger signal-lighted connector of the present invention can be a high-definition multimedia interface (HDMI) connector. The printed circuit 21*a* is connected to the seventeenth terminal of HDMI connector, while the printed circuit 21*b* is connected to the nineteenth terminal of the HDMI connector. Alternatively, the trigger signal-lighted connector of the present invention can be, but not limited to, another type of connector such as a universal serial bus (USB) connector.

In the trigger signal-lighted connector of the present invention, the light-emitting component 22 can be, but not limited to, a light-emitting diode (LED) or a color-changeable LED.

In the trigger signal-lighted connector of the present invention, the light-emitting component 22 can be mounted on one face of the adapter circuit board 20. Alternatively, at least one light-emitting diode 22 is mounted on each of two opposite faces of the adapter circuit board 20. The number and the layout of the light-emitting components 22 on the adapter circuit board 20 are not limited.

The trigger signal-lighted connector of the present invention is characterized in that the insulation layer 30 is made of transparent material and at least one light-emitting component 22 is disposed on the adapter circuit board 20. The light-emitting component 22 has two electrode pins 221, 222. The electrode pin 221 is connected to the printed circuit 21*a*, which is connected to the grounding terminal 11*a*, while the electrode pin 222 is connected to the printed circuit 21*b*, which is connected to the trigger signal terminal 11*b*. Accordingly, when an electronic device connected to the connector is selectively turned on, the trigger signal will trigger and light up the light-emitting component 22. Therefore, a display can be connected to an AV player, a set-top box, a game machine, a digital camera, etc. via the signal transmission wires of the present invention respectively. When the AV signals of the AV player are selectively displayed on the display, the trigger signal terminal 11*b* of the connector connected between the display and the AV player is turned on and current passes through the signal transmission wire to trigger and light up the light-emitting component 22 on the signal transmission wire. On the other hand, no current passes through the trigger signal terminal 11*b* of the connector connected to the other signal transmission wire of the display so that the light-emitting component 22 of the connector will not be triggered to emit light. Accordingly, a user can check whether the light-emitting component 22 of the connector is lighted up to judge which electronic device is currently activated and operated.

Figure 5:
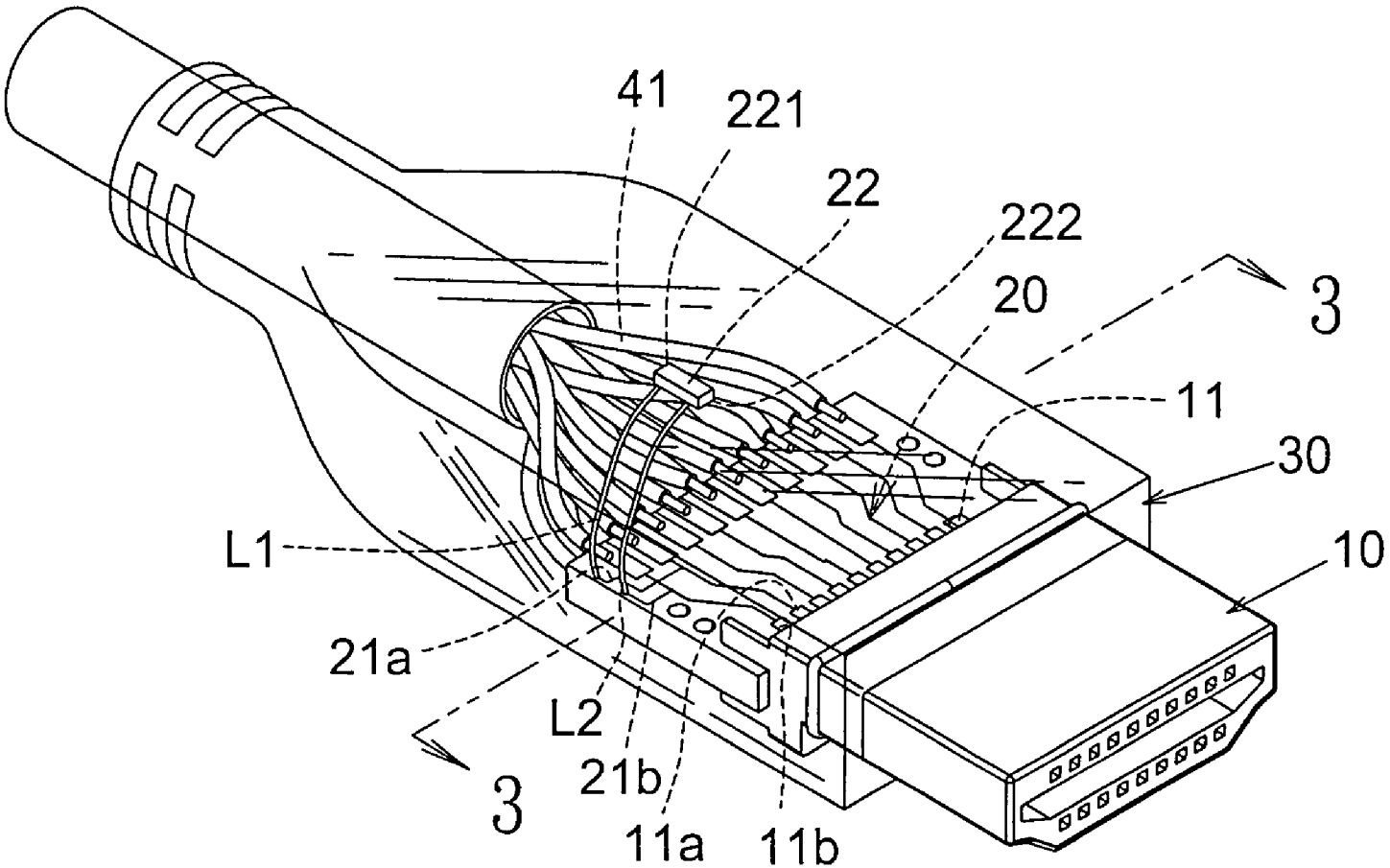
FIG. 5 is a perspective view of another preferred embodiment of the connector of the present invention.

Referring to FIG. 5, in the trigger signal-lighted connector of the present invention, the electrode pin 221 of the light-emitting component 22 is connected to the printed circuit 21*a* via a lead L1, which is connected to the grounding terminal 11*a*, while the electrode pin 222 of the light-emitting component 22 is connected to the printed circuit 21*b* via a lead L2, which is connected to the trigger signal terminal 11*b*. Accordingly, when an electronic device connected to the connector is selectively turned on, the trigger signal will trigger and light up the light-emitting component 22. The light-emitting component 22 can be installed in a suitable position as desired.

Figure 6:
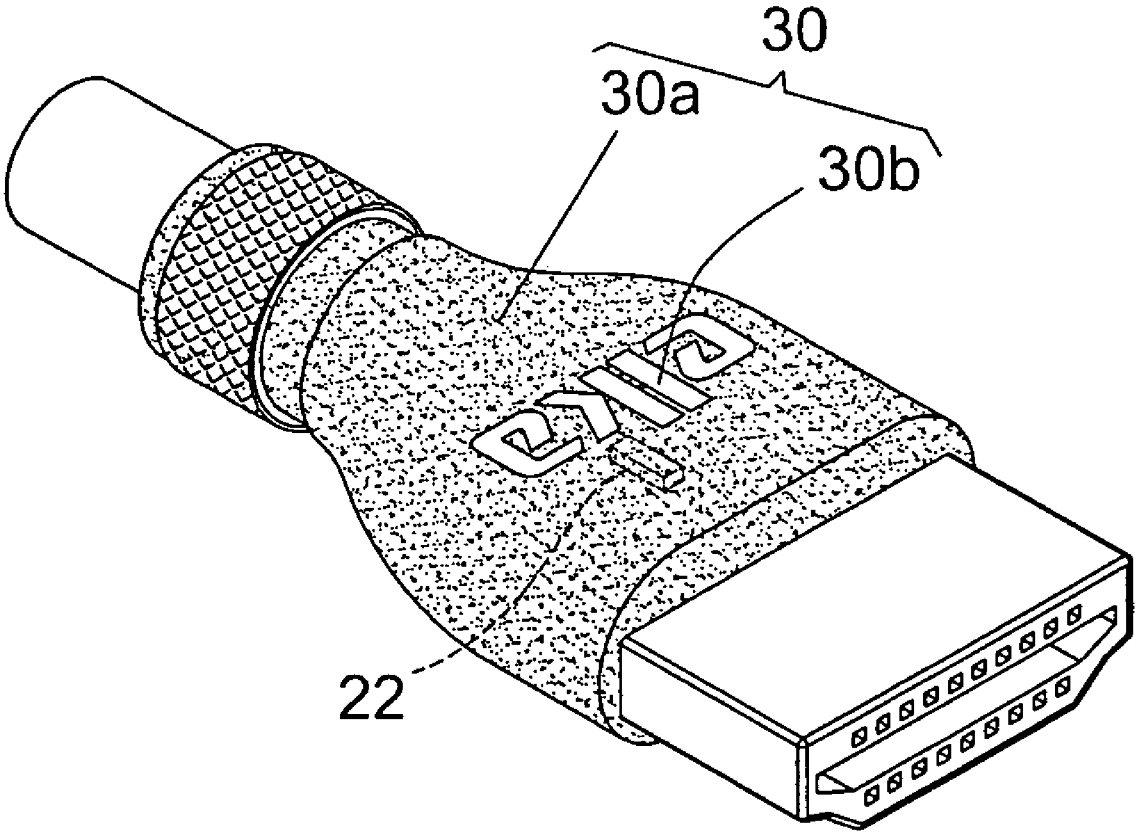
FIG. 6 is a perspective view of still another preferred embodiment of the connector of the present invention.

Referring to FIG. 6, in the trigger signal-lighted connector of the present invention, the insulation layer 30 is partially opacity-treated such as painted or colored to form an opaque region 30*a*. In this case, only some parts 30*b* of the insulation layer 30 are transparent. The transparent parts 30*b* of the insulation layer 30 can have the form of a trademark, descriptive characters, a decorative figure or the like. When the light-emitting component 22 in the insulation layer 30 is lighted up, the light-emitting component 22 emits light outward through the transparent parts 30*b* to present the trademark, descriptive characters or decorative figure.

The above embodiments are only used to illustrate the present invention, not intended to limit the scope thereof. Many modifications of the above embodiments can be made without departing from the spirit of the present invention.

What is claimed is:

1. A trigger signal-lighted connector comprising:

(a) a terminal housing in which multiple terminals are inlaid;

(b) an adapter circuit board having multiple lines of printed circuits, each printed circuit being connected between one of the terminals and one of multiple signal wires, one of the printed circuits being connected to a grounding terminal, while another of the printed circuits being connected to a trigger signal terminal; and (c) an insulation layer wrapping the terminal housing, the adapter circuit board and the signal wires, the connector being characterized in that the insulation layer is made of transparent material and at least one light-emitting component is disposed on the adapter circuit board, the light-emitting component having two electrode pins, one of the electrode pins being connected to the printed circuit, which is connected to the grounding terminal, while the other of the electrode pins being connected to the printed circuit, which is connected to the trigger signal terminal, whereby when an electronic device connected to the connector is selectively turned on, a trigger signal will trigger and light up the light-emitting component.

2. The trigger signal-lighted connector as claimed in claim 1, wherein the connector is a high-definition multimedia interface (HDMI) connector, one of the printed circuits being connected to the seventeenth terminal of HDMI connector, while another of the printed circuits being connected to the nineteenth terminal of the HDMI connector.

3. The trigger signal-lighted connector as claimed in claim 1, wherein the insulation layer is partially opacity-treated to form an opaque region, whereby only some parts of the insulation layer are transparent.

4. The trigger signal-lighted connector as claimed in claim 3, wherein the transparent parts of the insulation layer have the form of a trademark, characters or a figure.

5. The trigger signal-lighted connector as claimed in claim 3, wherein one of the electrode pins of the light-emitting component is connected to the printed circuit via a lead, which is connected to the grounding terminal, while the other of the electrode pins of the light-emitting component is connected to the printed circuit via another lead, which is connected to the trigger signal terminal.

* * * * *